US007047674B1

(12) United States Patent
Garvie

(10) Patent No.: US 7,047,674 B1
(45) Date of Patent: May 23, 2006

(54) CLEAT FOR FOOTWEAR

(76) Inventor: Bruce Henry Garvie, PO Box 1043, Northcliff - 2115, Johannesburg (ZA)

( * ) Notice: Subject to any disclaimer, the term of this patent is extended or adjusted under 35 U.S.C. 154(b) by 492 days.

(21) Appl. No.: 09/584,375

(22) Filed: May 31, 2000

(30) Foreign Application Priority Data

May 31, 1999 (ZA) ..... 99/3671

(51) Int. Cl.
*A43B 5/00* (2006.01)
*A43C 15/00* (2006.01)

(52) U.S. Cl. ..... 36/134; 36/67 R; 36/59 A; 36/127

(58) Field of Classification Search ..... 36/134, 36/67 R, 67 A, 67 D, 59 A, 127
See application file for complete search history.

(56) References Cited

U.S. PATENT DOCUMENTS

| | | | | | |
|---|---|---|---|---|---|
| 2,222,650 | A | * | 11/1940 | Brady | 36/67 D |
| 4,445,289 | A | * | 5/1984 | Beneteau | 36/134 |
| 4,472,098 | A | * | 9/1984 | Kiefer | 36/134 |
| 4,587,748 | A | | 5/1986 | Collins | |
| 4,644,672 | A | * | 2/1987 | Dassler et al. | 36/134 |
| 4,783,913 | A | * | 11/1988 | Aoyama | 36/134 |
| 4,791,692 | A | * | 12/1988 | Collins | 36/67 A |
| 5,036,606 | A | * | 8/1991 | Erich et al. | 36/134 |
| 5,259,129 | A | * | 11/1993 | Deacon et al. | 36/134 |
| 5,367,793 | A | * | 11/1994 | Deacon et al. | 36/67 D |
| 5,794,367 | A | * | 8/1998 | Carroll | 36/134 |
| 5,848,482 | A | * | 12/1998 | Bathrum | 36/134 |
| 5,906,059 | A | | 5/1999 | Singer et al. | |
| 5,926,980 | A | * | 7/1999 | Adam | 36/134 |
| 5,996,260 | A | | 12/1999 | MacNeill | |
| 6,006,454 | A | | 12/1999 | Sitzler, Sr. | |
| 6,009,640 | A | * | 1/2000 | Deacon et al. | 36/134 |
| 6,012,239 | A | | 1/2000 | Conway et al. | |
| 6,023,860 | A | | 2/2000 | McMullin | |
| 6,052,923 | A | | 4/2000 | McMullin | |
| 6,138,386 | A | * | 10/2000 | Singer et al. | 36/127 |
| 6,154,984 | A | * | 12/2000 | Adam | 36/134 |
| 6,182,379 | B1 | * | 2/2001 | Savage | 36/67 D |
| 6,327,797 | B1 | * | 12/2001 | Deacon et al. | 36/134 |

FOREIGN PATENT DOCUMENTS

| | | | | |
|---|---|---|---|---|
| DE | 2733846 A | * | 2/1979 | 36/67 R |
| EP | 342232 | * | 2/1989 | |
| FR | 2644989 A1 | * | 10/1990 | 36/67 D |

* cited by examiner

*Primary Examiner*—Anthony Stashick
(74) *Attorney, Agent, or Firm*—Welsh & Flaxman LLC

(57) ABSTRACT

A cleat for an article of footwear comprising an insert made from a synthetic plastic material and a synthetic plastic traction member. The traction member is secured to the insert during a molding process, wherein the insert is made from a synthetic plastic material having a greater hardness than the traction member. The insert having a stem portion, an engagement means at a first end of the stem portion for releasable engagement with a complementary engagement formation defined on an undersole of the article of footwear and a securing formation extending from the stem portion for securing the traction member to the stem portion. Further, the cleat is formed in a single, economic injection molding process wherein the insert is formed from a plastic material which is of sufficient hardness to alleviate past problems experienced with stripping of a thread on the stem. The insert is formed of a synthetic plastic material having a hardness between 75 MPa and 85 MPa.

6 Claims, 3 Drawing Sheets

CLEAT FOR FOOTWEAR

BACKGROUND OF THE INVENTION

1. Field of the Invention

The invention relates to a composite cleat for sports shoes. More particularly, the invention relates to an insert for a cleat, a two component cleat for an article of footwear and a method of manufacturing the cleat.

2. Description of the Prior Art

The known prior art soft cleats disclose composite two component cleats. However, these prior art cleat inserts are made from metal. The manufacture of inserts from metal has lead to bonding problems such that when torque is applied to the cleat during the insertion and removal from the shoe separation occurs between the insert and the traction member.

As such, the present invention sets forth to overcome this bonding problem while creating an economical injection molding process offering numerous advantages discussed below.

SUMMARY OF THE INVENTION

The invention relates to a cleat for an article of footwear. The cleat includes an insert made from a synthetic plastic material and a synthetic plastic traction member. The traction member is secured to the insert during a molding process, wherein the insert is made from a synthetic plastic material having a greater hardness than the traction member. The insert has a stem portion, an engagement means at a first end of the stem portion for releasable engagement with a complementary engagement formation defined on an undersole of the article of footwear and a securing formation extending from the stem portion for securing the traction member to the stem portion. The cleat is formed in a single, economic process and the insert is formed from a plastic material which is of sufficient hardness to alleviate past problems experienced with stripping of threads on the stem. Because both the insert and the traction member are formed of synthetic plastic materials, they are able to bond in the manufacturing process at controlled temperatures. This alleviates problems experienced with prior art cleats where a metal insert is used and insufficient bonding between the insert and the traction member creates problems when torque is applied to the cleat during the insertion and removal of the cleat from the shoe. The insert is formed of a synthetic plastic material having a hardness between 75 MPa and 85 MPa.

It is, therefore, an object of the invention to provide a composite cleat for an article of footwear comprising an insert made from a synthetic plastic material and a plastic traction member which is secured to the insert during a molding process. The insert is made from a synthetic plastic material having a greater hardness than the traction member.

It is a further object of the invention to provide the securing formation on the insert with a central raised spike opposite the stem portion which is aligned with a central traction member formation or center spike on the traction member. The raised spike on the insert and the aligned center spike on the traction member cooperate to function as a visual wear indicator for the cleat. That is, as the center spike on the traction member is worn away the raised spike on the insert will become visible.

It is still a further object of the invention to provide an insert and traction member made from different color materials. The traction member may be of a resiliently deformable synthetic plastic material and be formed about the insert, so that the securing formation and the second end of the stem are encased in the traction member, with the first end of the stem portion, on which the engagement means is defined, protruding from the traction member. The synthetic plastic material may be polyurethane, or the like.

Still another object of the invention is to provide a method of manufacturing a cleat for an article of footwear, wherein the method includes the steps of 1) forming an insert via an injection molding process and 2) forming a traction member about the insert in a second step of the injection molding process. The insert may be integrally molded in an injection molding process. The synthetic plastic material may be a polyamide such as nylon, or the like.

Yet another object of the invention is to have an insert and traction member made from different synthetic plastic materials which bond during the molding process at a temperature range of between 50–70° C.

Another object of the invention is to form the insert from a synthetic plastic material having a hardness between 75 MPa and 85 MPa.

Another aspect of the invention is an insert for a cleat for an article of footwear comprising a stem portion, an engagement means at a first end of the stem portion for releasable engagement with a complementary engagement formation defined on an undersole of the article of footwear, and a securing formation extending from the stem portion for securing a traction member to the stem portion, wherein the securing formation includes a raised spike extending therefrom in opposition to the stem portion.

The securing formation may be in the form of a skirt or flange which extends substantially orthogonally from the stem portion. The flange may be spaced from a secured end of the stem portion. A plurality of circumferentially spaced apertures may be defined in the flange portion.

The stem portion may be in the form of a round cylindrical element, with the engagement means being in the form of an external screw thread which is defined on the element for engagement with an internal screw thread which is defined in a complementary socket in the underside of the article of footwear.

A second aspect of the invention is a traction member. The traction member may be substantially round when viewed from above, having a substantially planar upper surface, with the first portion of the stem projecting from the upper surface so that the upper surface in use abuts the undersole of the article of footwear. A plurality of traction formations may be defined on a bottom surface of the traction member. The traction formations may be in the form of spaced apart spikes.

A central traction formation or spike may be defined on the bottom surface of the traction member. It will be appreciated that the central traction formation will be aligned with the second end of the stem of the insert. In a preferred embodiment of the invention, the second end of the insert extends into the central traction formation.

The traction member may be of a different color to the insert. It will further be appreciated that, when the central traction formation is worn away by use, at least a part of the second end of the insert will be visible. This serves as a wear indicator, to indicate to a user of the article of footwear when to replace the cleat.

Other objects, advantages and salient features of the invention will become apparent from the following detailed description, which taken in conjunction with the annexed drawings, discloses a preferred, but non-limiting, embodiment of the subject invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
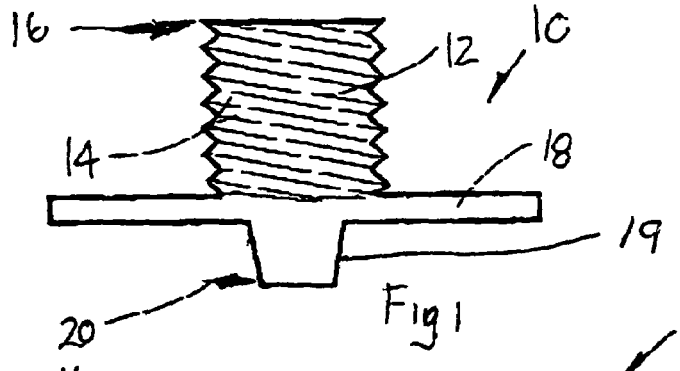
FIG. 1 is a schematic side view of an insert, in accordance with a first aspect of the invention, for a cleat for an article of footwear.

With reference to FIG. 1, reference numeral 10 generally indicates an insert, in accordance with the invention, for a cleat for an article of footwear.

The insert 10 includes a stem portion 12 with an engagement means in the form of an external screw thread 14 being defined on a first end 16 of the stem portion 12 for releasable engagement with a complementary engagement formation of an undersole of the article of footwear or golf shoe (not shown).

The insert 10 also includes a securing formation in the form of a skirt or flange 18 which extends substantially orthogonally from a second end 20 of the stem portion 12. The flange 18 has radially extending limbs 22 (as shown in FIGS. 3 to 6 of the drawings in dotted lines). Four circumferentially spaced apart apertures 24 are defined in the flange 18. The second end 20 of the insert 10 includes a raised spike 19 in opposition to the stem 12.

The insert 10 is formed of a synthetic plastic material. In accordance with a preferred embodiment of the present invention, the synthetic plastic material may be an unreinforced impact modified PA6 grade plastic material with low density, such as obtainable from BASF South Africa under the trade name "Ultramid B3Z", and having a ball indentation hardness of 80 MPa. Further, it has now been found that the insert may be formed from LARIPUR-30% glass filled crystalline polymer Laripur 72D25, CRASTIN glass filled crystalline polymer Crastin S600 or NYLON glass filled crystalline polymer Nylon B3–6. The insert 10 is integrally molded in a first step of an injection molding process at a barrel temperature between 210–285° C. and molded at a temperature of between 60–70° C.

Referring now to FIGS. 2 to 5 of the drawings, a cleat 26 in accordance with the present invention is disclosed. The cleat 26 is adapted for use with an article of footwear or golf shoe. Each cleat 26 includes the insert 10 as shown in FIG. 1 and a traction member 28. The traction member 28 is secured to the securing formation 18 of the insert 10. The traction member 28 is of a resiliently deformable synthetic plastic material and is formed about the insert 10 in an injection molding process. Once formed the securing formation 18 and the second end 20 of the stem portion 12 are encased in the traction member 28, with the first end 16 of the stem portion 12, on which the screw thread 14 is defined, protruding from the traction member 28.

In accordance with a preferred embodiment of the present invention, the traction member 28 is made from LARIPUR 5225, 51D Shore, HYTREL 4056, 90–95 Shore-A or ELASTOLLAN 598, 90–95 Shore-A and injection molded at a barrel temperature of 150–180° C. and mold temperature of 50–60° C. It will be appreciated that, because both the insert 10 and the traction member 28 are formed of synthetic plastic materials, they will rigidly bond in the injection molding process at controlled temperatures. In fact, the insert 10 and traction member 28 may be made from the same synthetic plastic material with the hardness of the materials varied to produce a harder insert 10 than traction member 28. One known way of varying the hardness of the synthetic plastic materials is by reinforcing the insert material with glass and differing the barrel and mold temperature during the injection molding process.

Figure 2:
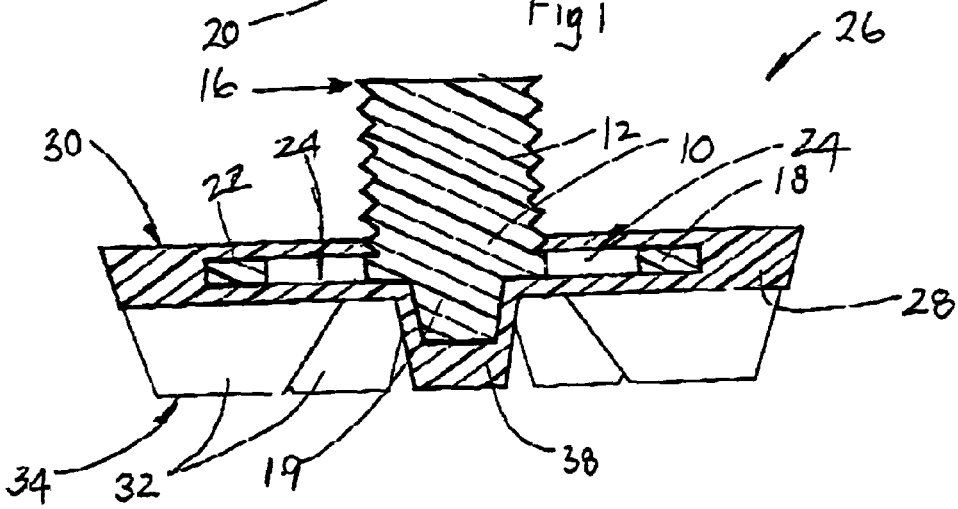
FIG. 2 is a schematic side sectional view taken at II—II of FIG. 4, of a combined insert and traction member forming a cleat, in accordance with a second aspect of the invention, for use with an article of footwear.
Figure 3:
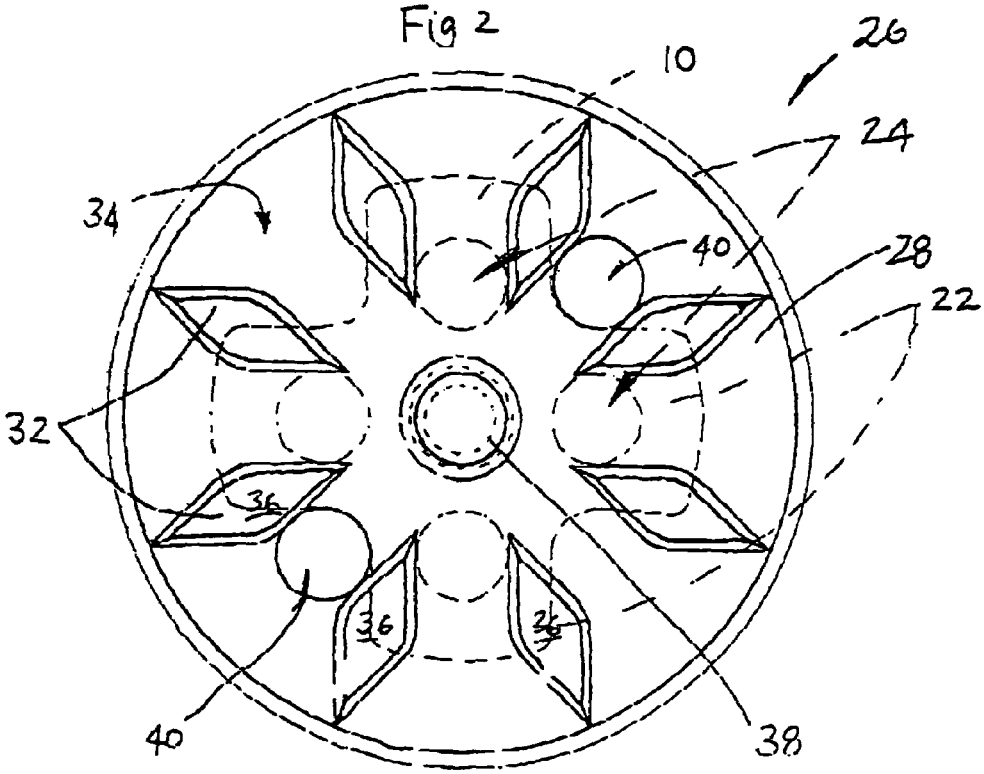
FIG. 3 is a schematic plan view of a first embodiment of the traction member with the insert shown in dotted lines.
Figure 4:
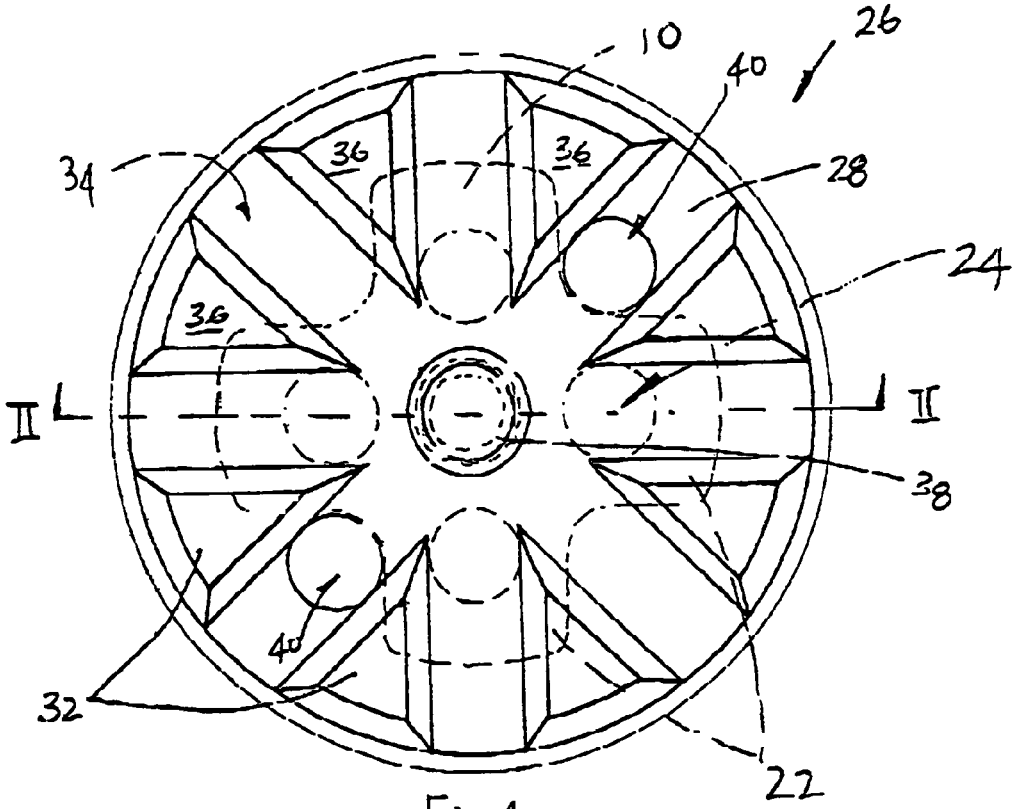
FIG. 4 is a schematic plan view of a second embodiment of the traction member with the insert shown in dotted lines.
Figure 5:
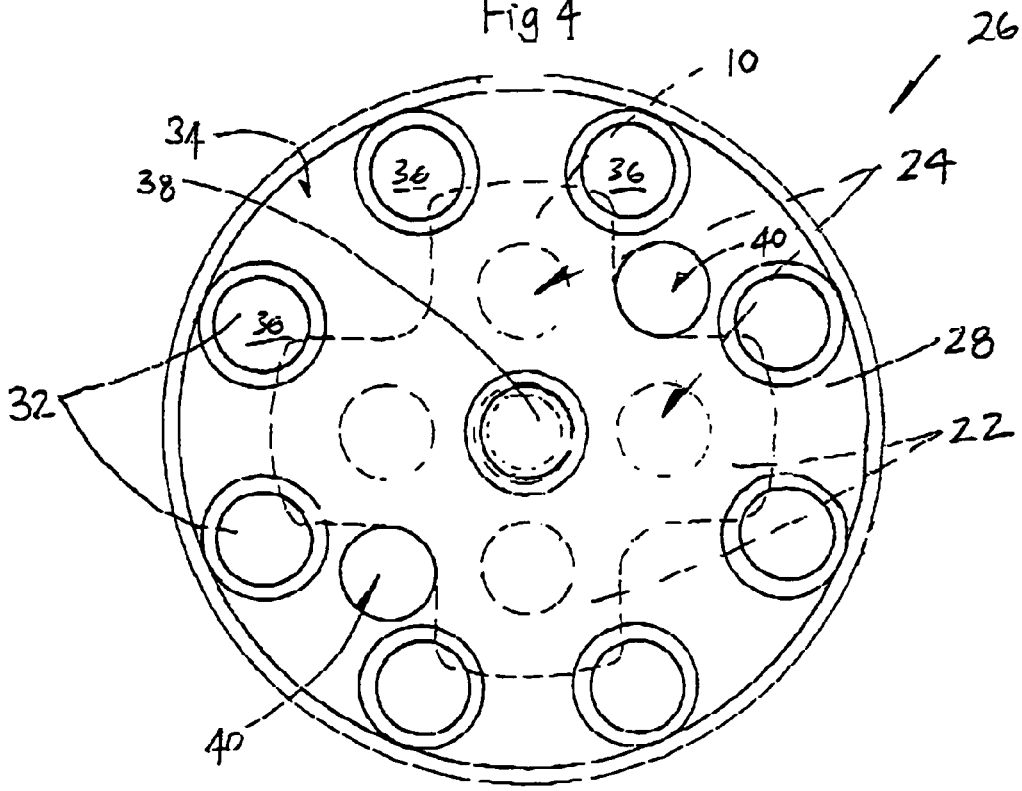
FIG. 5 is a schematic plan view of a third embodiment of the traction member with the insert shown in dotted lines.
Figure 6:
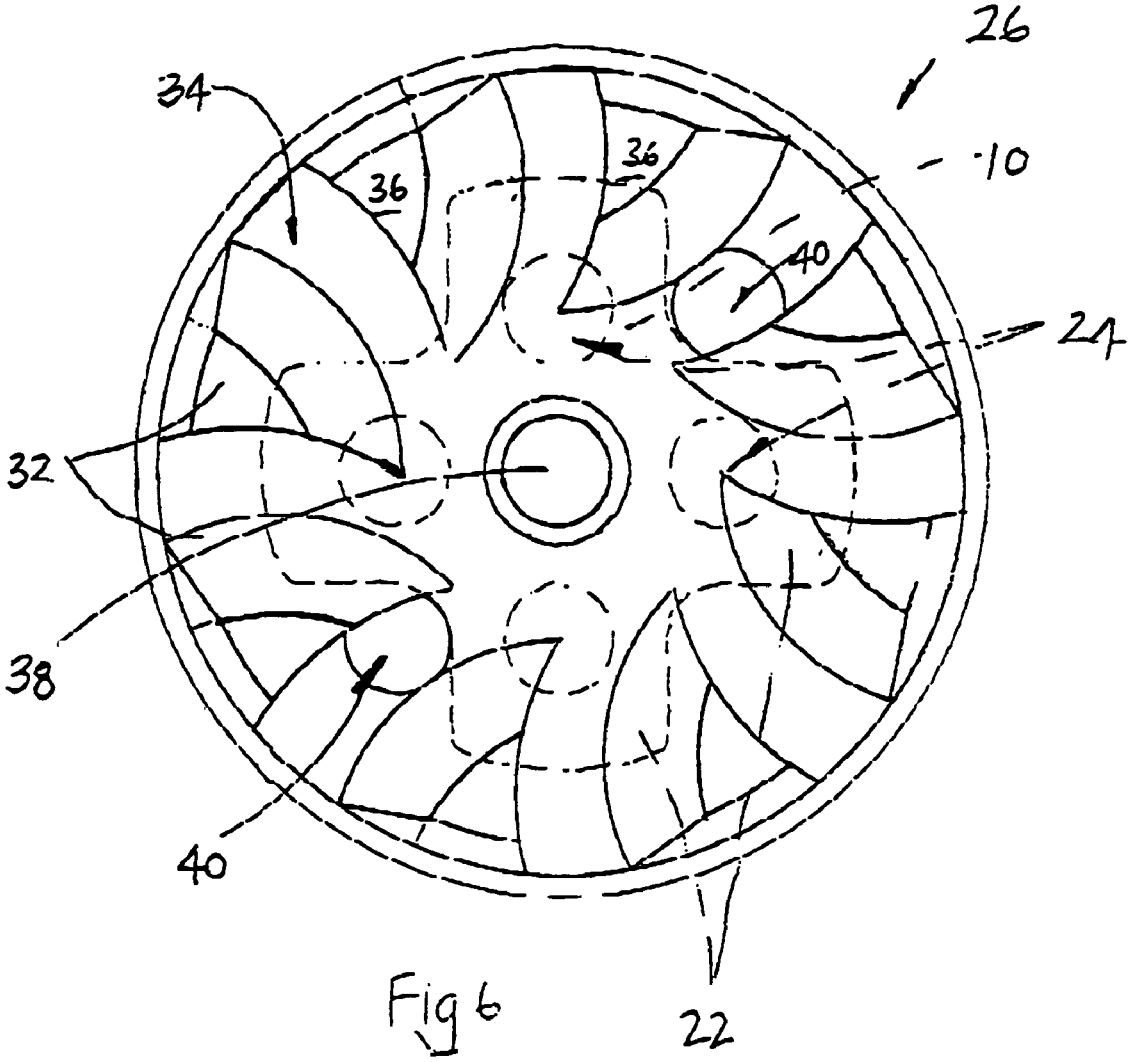
FIG. 6 is a schematic plan view of a fourth embodiment of the traction member with the insert shown in dotted lines.

Each traction member 28 is substantially circular in plan view, having a substantially planar upper surface 30 (as shown in FIG. 2 of the drawings) which in use abuts the undersole of a shoe. A plurality of traction spikes 32 are defined on a bottom surface 34 of each traction member 28. The spikes 32 may be triangular in shape (FIG. 4), rhombohedrical (FIG. 3), circular (FIG. 5), or wedge-like (FIG. 6). Each spike 32 has a substantially planar contact portion 36 to enhance wear.

A central traction formation or spike 38 is defined on the bottom surface 34 of each traction member 28. The central traction spike 38 is aligned with the raised spike 19 on the second end 20 of the stem portion 12 of the insert 10. In fact, the raised spike 19 sits within the central spike 38 in a manner providing for early wear detection as discussed below.

The traction member 28 may be of a different color than the insert 10. Thus, when the central traction formation 38 is worn away by use, a part of the raised spike 19 of the insert will be visible. This feature serves as a wear indicator, alerting a user of the shoe to replace the cleat 26. As mentioned above, the fact that the raised spike 19 extends within the central spike 38 allows for early detection of cleat wear. Specifically, the spike 19 is revealed when only the top portion of the central spike 38 is worn. A user is thereby readily warned as to the wear status of the cleat 26.

A pair of openings 40 are defined in each traction member 28. The openings allow the teeth of a tightening member to be inserted for insertion and removal of the cleat 26 from the shoe.

In use, the cleat 26 is engaged to the undersole of the shoe by screwing the first end 16 of the stem portion 12 of the insert 10 into a complementary socket defined in the shoe.

While various preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. A cleat for an article of footwear consisting entirely of plastic, the cleat comprising:

an insert and a plastic traction member, the insert and traction member constituting separate and distinct elements formed at distinct times in the manufacture process;

the insert is from a synthetic plastic material, wherein the insert has a stem portion with engagement means for releasable engagement with a complementary formation defined on an undersole of the article of footwear;

the plastic traction member is secured to the insert during a molding process, and encases the insert with the exception of the engagement means, thereby holding the traction member captive on the insert; wherein the insert is made entirely from a synthetic plastic material having a greater hardness than the traction member; and wherein the insert includes a stem portion having a first end and a second end;

an engagement means at the first end of the stem portion for releasable engagement with a complementary engagement formation defined on an undersole of the article of footwear; and a securing formation extending from the second end of the stem portion for securing the traction member to the insert; and a raised spike opposite the first end of the stem portion, the raised spike being aligned with a traction member spike to cooperate therewith and function as a visual wear indicator for the cleat.

2. The cleat according to claim 1, wherein the insert is formed of a synthetic plastic material having a hardness between 75 MPa and 85 MPa.

3. The cleat according to claim 1, wherein the insert and traction member are made from different color materials.

4. A cleat according to claim 1, wherein the traction member includes a pair of passages arranged immediately adjacent to the insert, for receiving corresponding portions of a tool for fastening the cleat to the article of footwear.

5. The cleat according to claim 1, wherein the securing formation is a flange extending radially from the stem portion.

6. The cleat according to claim 5, wherein the flange includes a plurality of apertures extending therethrough.

* * * * *